US005879469A

United States Patent [19]

Avram

[11] Patent Number: 5,879,469

[45] Date of Patent: Mar. 9, 1999

[54] DISHWASHING METHOD AND DETERGENT COMPOSITION THEREFOR

[75] Inventor: Nir Avram, Meitar, Israel

[73] Assignee: Deeay Technologies Ltd., Bnei Braq, Israel

[21] Appl. No.: 779,205

[22] Filed: Jan. 6, 1997

[51] Int. Cl.[6] ..... B08B 3/00; B08B 3/04

[52] U.S. Cl. ..... 134/25.2; 134/28; 134/29; 510/221; 510/229; 510/230; 510/233; 510/235

[58] Field of Search ..... 134/25.2, 28, 29; 510/221, 229, 230, 233, 235

[56] References Cited

FOREIGN PATENT DOCUMENTS

| | | |
|---|---|---|
| 2206382 | 6/1974 | France . |
| 23 43 145 | 3/1975 | Germany . |
| WO95/24148 | 9/1995 | WIPO . |
| WO96/15215 | 5/1996 | WIPO . |
| WO96/17047 | 6/1996 | WIPO . |

*Primary Examiner*—Zeinab El-Arini

*Attorney, Agent, or Firm*—Gary M. Nath; Harold L. Novick; Nath & Associates

[57] ABSTRACT

A dishwashing method is dislosed wherein two detergent compositions, one being alkalinic and the other acidic are applied in sequence onto the dishes. The liquid compositions are applied onto the dishes directly without or with only a moderate dilution such that once applied onto the dishes they input respective alkalinic and acid pH's on the surface of the dishes.

12 Claims, No Drawings

DISHWASHING METHOD AND DETERGENT COMPOSITION THEREFOR

FIELD OF THE INVENTION

The present invention is generally in the field of dishwashers and relates to a detergent system comprising two different types of detergents which are used in different sequences of the dishwashing cycle. Further provided arc a method of automatic dishwashing making use of such detergents and a composition which may be used as such a detergent.

BACKGROUND OF THE INVENTION AND PRIOR ART

Dishwashers are widely used both domestically as well as in mass eating places, e.g. restaurants. In such systems, a detergent, which may be a dry detergent, e.g. supplied as a powder, or a liquid detergent is applied onto the dishes at predetermined parts of the washing cycle. In certain dishwashers a combination of detergents is used.

Detergents can have an acidic pH or an alkalinic pH. There are advantages in using detergents giving rise to a high pH when being in solution, as well as such giving rise to a low pH. U.S. Pat. No. 5,338,474 (Fitch et al.) discloses a powdered automatic dishwashing detergent composition which, once in solution imparts on the solution a pH of 8–13, preferably 9–12. The composition of Fitch et al. is specifically suitable for removal of carbonoid stains from plastic ware. A composition having an alkalinic pH is also disclosed in International (PCT) Patent Application, WO 96/17047. An acidic detergent is disclosed in PCT Application 96/15215. The detergent of this patent has a pH lower than 2, and is useful in the food industry.

SUMMARY OF THE INVENTION

The present invention has as its object the provision of a novel dishwashing method. It is particularly an object of the invention to provide such a method wherein the washed dishes are rapidly disinfected.

It is another object of the invention to provide detergent compositions and a detergent system useful in the above method.

The present method provides, by a first of its aspects, a dishwashing method comprising:

(a) rinsing with water (b) applying first liquid detergent composition onto the dishes, (c) rinsing with water, (d) applying a second liquid detergent composition onto the dishes, and (e) rinsing with water;

one of said first or said second detergent compositions having alkalinic pH (alkalinic detergent composition) and the other of the detergent compositions having an acidic pH (acidic detergent composition); the liquid detergent compositions being applied onto the dishes without dilution or after being only moderately diluted with water such that once applied onto the dishes they impart respective acidic and alkalinic pH's on the surfaces of the dishes.

In accordance with another of its aspects, the present invention provides a detergent composition for use in the above method. Also provided is a detergent system, comprising detergent compositions having an alkalinic pH and a detergent composition having an acidic pH.

In the following description, the detergent composition having an alkalinic pH will be referred to herein as "alkalinic detergent composition"; the liquid detergent composition having an acidic pH will be referred to herein as "acidic detergent composition". The term "dishes", as used herein means to denote all types of items which may be washed in a dishwasher, e.g. dishes, cooking utensils, cutlery, cups, mugs, etc.

In accordance with a preferred embodiment of the invention, the alkalinic detergent composition has a high alkalinity. Preferably, the detergent compositions are applied onto the surface of dishes without prior dilution with water.

Said alkalinic detergent composition has preferably a pH above about 11; said acidic detergent has preferably a pH below about 4. More preferred are alkalinic and acidic detergent compositions having a pH below about 3 and above about 13, respectively; such which give respective pH's of above about 14 and below about 2, are particularly preferred.

The alkalinity of the alkalinic detergent composition and the acidity of the acidic detergent composition are preferably to a degree to achieve a high alkalinity and high acidity on the dishes, respectively. The free alkali level in the alkalinic detergent composition is thus preferably within the range of about 50–260 mg KOH/gr; the free acid in the acidic detergent composition is thus preferably within the range of about 25–100 mg KOH/gr.

In accordance with a preferred embodiment of the invention, the application of the alkalinic detergent composition precedes that of the acidic detergent composition; in other words, the detergent composition applied in step (b) above is the alkalinic detergent composition, whereas the detergent composition applied in step (d) is the acidic detergent composition; However, as one may appreciate, a method wherein the order of application of the detergent compositions is reversed, i.e. the application of the acidic detergent composition is in step (b) and that the alkalinic detergent composition in step (d), is also conceivable and accordingly within the scope of the invention.

In addition, as one may also appreciate, additional steps of detergent application and rinsing may be added to the above washing sequence.

One feature of a dishwashing method utilizing both an alkalinic detergent composition and an acidic detergent composition, each one being applied in a different step of the washing sequence, is that thereby the detergent system is capable of rapidly cleaning a wide variety of different stains. In addition, the exposure of the surfaces of the dishes to two high and opposite pH's, allows effective disinfection of the dishes (microorganisms are usually sensitive and are destroyed by exposure to either an acidic pH or an alkalinic pH, and the effective exposure of the surfaces of the dishes to these two opposite pH's, kills most types of microorganisms which can be found on such dishes). The antiseptic properties of the detergent system may be improved by adding antimicrobial agents to one or both of the detergent compositions, particularly to the alkalinic detergent composition.

In accordance with a preferred embodiment of the invention, there is a rapid switching, within a few second, between the first detergent composition and the second detergent composition. Without the following explanation being regarded as limiting, it is believed that such a rapid switching gives rise to a pH shock to microorganisms which may be contained on the dishes, and such a shock by itself has a very strong disinfecting affect.

The detergent compositions are preferably a priori in a liquid form. Alternatively, the detergent composition is provided a priori in the form of a solid composition of matter and the liquid detergent composition is then formed by passing water, on the solid composition of matter. Still in the alternative, the detergent compositions may be provided a priori stored as a dry particulate matter (e.g. powder) and the liquid detergent is then formed by mixing with water prior to use. The liquid detergent compositions are preferably applied on the dishes through spraying nozzles. The spraying nozzles may be stationary nozzles scattered throughout the washing chamber of an automatic washing machine or may be nozzles exposed on a moveable, e.g. rotational, arm. Typically, in order to allow rapid switching from one detergent composition to the other and from a detergent composition to rinsing water, each one of these liquids, i.e. the alkalinic detergent composition, the acidic detergent composition and water, are each sprayed on the dishes through separate nozzles. A dishwasher useful for carrying out the method is disclosed in WO 95/24148.

In the following, concentrations of ingredients will be given as "%" (w/w) meaning the number of weight units of ingredients in 100 weight units of composition.

Exemplary ranges of ingredients in the alkalinic detergent and in the acidic detergent, are shown in Tables I and II, respectively:

TABLE I (Alkalinic Detergent Composition)

| Ingredient | % (w/w) |
|---|---|
| Complexing agent | 0.5–5.0 |
| Inorganic alkali | 5.0–20.0 |
| Organic Cosolvent | 1.0–10.0 |
| Amphoteric surfactant | 2.0–14.0 |
| Antibacterial agent | 0.01–2.0 |
| Demineralized water | up to 100 |
| Total | 100.0 |

TABLE II (Acidic Detergent Composition)

| Ingredient | % (w/w) |
|---|---|
| Organic acid | 2.0–15.0 |
| Organic Cosolvent | 1.0–10.0 |
| Alcohol | 1.0–10.0 |
| Acidic surfactant | 0.5–5.0 |
| Demineralized water | up to 100 |
| Total | 100.0 |

Examples of ingredients used in the alkalinic detergent composition are the following:

Complexing agent—EDTA (e.g. mono sodium, desodium and tetra sodium salts) NTA, polyacrylates, phosphonates;

Inorganic alkali—NaOH, KOH;

Organic Cosolvent—Glycol type cosolvent such as butyl glycol and propyl glycol, ethyl ether;

Amphoteric surfactant—Cocoamphocarboxyglyconate, cocoamphocarboxypropionate, capric/-caprylicamphoacetate;

Antibacterial agent—Glycin n-(3-aminopropyl)-C10-16 alkyl, triclosane, benzalkonium, chlorohexidine, gluconate;

Demineralized water—Distilled water, soft water (water from which divalent salts have been removed).

Examples of ingredients used in the acidic detergent composition are the following:

Organic acid—Citric acid, phosphoric acid, glycolic acid, lactic acid;

Organic Cosolvents—Glycol type cosolvent such as butyl glycol and propyl glycol, ethyl ether;

Alcohol—Isopropyl alcohol, ethyl alcohol, butyl alcohol, isobutyl alcohol;

Acid surfactant—Polyoxyethylene alkylphosphate ester, dodecylbenzene, sulfonic acid;

Demineralized water—Distilled water, soft water (water from which divalent salts have been removed).

The detergent composition is a priori colorless and typically, a coloring agent is added, usually a different coloring agents to the alkalinic and to the acidic detergent compositions.

The invention will now be illustratcd by the following non-limiting examples.

EXAMPLES

Example 1

Preparation of an Alkalinic Detergent Composition

An alkalinic detergent composition of the invention may be prepared by the following preparation procedure;

(a) A soft (demineralized) water is added to a prewashed vessel. The vessel is agitated at a moderate speed and is continuously cooled.

(b) EDTA powder is added and the solution is agitated until it becomes completely clear.

(c) Addition of potassium hydroxide, typically in the form of an aqueous, highly concentrated solution of KOH, e.g 48% solution. The temperature is controlled such that it does not exceed about 15° C. above room temperature.

(d) Addition of propyl glycol methyl ether (PGME).

(e) Addition of an amphoteric surfactant, typically a low foam amphocarboxylate. The solution should then be agitated in a manner so as to avoid foam formation.

(f) Optional addition of an antibacterial agent, e.g. a betaine derivative.

(g) Addition of a color solution (optional).

(h) The solution is further agitated for an additional period of time, e.g. 15 minutes.

As will be appreciated the order of some of the steps may be altered. For example, the substances added in steps (c)–(g) may be added in a different order. Furthermore, it is possible also to add the various ingredients all at once, namely, combine steps (c)–(g), into one step.

A typical formulation of an alkalinic detergent composition is shown in the following Table III.

TABLE III

| Ingredient | % (w/w) |
|---|---|
| Demineralized water | 55.3 |
| Ethylene diamine tetra acetic acid (EDTA) - alkaline | 3.0 |
| 48% Potassium Hydroxide solution | 29.2 |
| 1-Methoxy-2-propanol | 5.0 |
| Mixed C8 amphocarboxylates | 7.0 |
| Glycin n-(3-aminopropyl)-C10-16 alkyl | 0.5 |
| FD&C Yellow 5 | Q.S.[1] |
| Total | 100.0 |

[1]Q.S. = Quantity sufficient

A composition having the ingredients shown in Table I has the characteristics shown in the following Table IV:

TABLE IV

| | |
|---|---|
| Appearance | Low viscous yellowish liquid |
| Density | 1.08–1.16 gr/cm$^3$ |
| m.p. | <–5° C. |
| Free Alkali | 140–160 mg KOH/gr |
| p.H. | >14.0 |

Example 2

Preparation of an Acidic Detergent Composition

An acidic detergent composition in accordance with the invention may be prepared as follows:

(a) A soft (dcmineralized) water is added to a prewashed vessel. The vessel is agitated at a moderate speed and is continuously cooled to about 10°–15° C. above room temperature.

(b) Citric acid powder is added and the solution is agitated until the solution becomes completely clear.

(c) Addition of PGME.

(d) Addition of isopropyl alcohol (IPA)

(e) Addition of phosphate ester surfactant. The solution should be agitated in a manner to avoid foam formation.

(f) Addition of a color solution.

(g) Mixing for additional period of time, e.g. 15 miinutes.

As will be appreciated the order of some of the steps may be altered. For example, the substances added in steps (c)–(g) may be added in a different order. Furthermore, it is possible also to add the various ingredients all at once, namely, combine steps (c)–(g), into one step.

An exemplary acidic detergent composition in accordance with the invention prepared as above comprises ingredients as shown in the following Table V:

TABLE V

| Ingredient | % (w/w) |
|---|---|
| Demineralized water | 88.3 |
| Citric acid | 6.0 |
| 1-Methoxy-2-propanol | 2.0 |
| 2-Hydroxy propane | 2.5 |
| Polyoxyethylene alkyl phosphate ester acid form | 0.7 |
| FD&C Yellow 5 | Q.S |
| FD&C Blue 1 | Q.S |
| | 100.0 |

The composition as shown in Table I has characteristics as shown in the following Table VI:

TABLE VI

| | |
|---|---|
| Appearance | Low viscous greenish liquid |
| Density | 0.97–1.03 gr/cm$^3$ |
| m.p. | <–5° C. |
| Free Acid | 45–55 mg KOH/gr |
| p.H. | <1.5 |

Example 3

Disinfectant activity of the Detergent System

A microbial test was performed in order to evaluate the disinfectant activity of a detergent system consisting of Tables I and II.

The test was performed as follows:

Pasteurized milk was tested for the presence of *Bacillus cereus*. No *Bacillus cereus* was found in the milk solution. The pasteurized milk was then inoculated with (1,000,000–10,000,000 cells/ml) *Bacillus cereus*. Non-inoculated milk served as control.

At first, both the contaminated milk, and the uncontaminated (non-inoculated) one were enumerated using spread plate method on Standard Plate Count agar.

Each of four coffee mugs was filled with 100 ml of the control milk. Then, another six coffee mugs were filled with 100 ml of the contaminated milk. All the coffee mugs were covered and remained untouched at room temperature for 24 hours. At the end of the 24 hr period, the milk solution was discarded from all mugs.

The bacteria in each of the mugs were enumerated by rubbing a sterile cotton swab over the entire surface of the mugs. The swab was then placed into a test tube containing 5 ml sterile phosphate buffered saline followed by vigorously mixing on a vortex. A sample from each test tube was taken to enumerate the bacteria, using a spread plate method.

Two mugs incubated with the control milk and three mugs incubated with the contaminated milk were put through a short wash cycle using the Fresh Cup™ dishwasher (manufactured by Deeay Technologies, Israel, disclosed in PCT Application WO 95/24148). The wash cycle consisting of the following steps:

(i) spraying water on the cups;

(ii) spraying an alkalinic detergent composition of Table I on to the cups allowing the detergent composition to remain on the cups for 15 seconds;

(iii) rinsing with water;

(iv) spraying the acidic detergent composition of Table II and allowing the detergent composition to remain on the cups for 3 seconds; and (v) rinsing again with water to remove the detergent.

Two other mugs incubated with the control milk and three other mugs incubated with the contaminated milk were put through a long cycle of the Fresh Cup™. The long cycle had similar steps to the short cycle as specified above, with a longer incubation period of about 4–5 seconds with each of the detergent compositions (steps (ii) and (iv)).

Enumerating the bacteria in each of the mugs was carried out in the same way as described above.

Results

After the milk was discarded from the mugs, *Bacillus cereus* in an amount exceeding 1,000,000 cells/ml were found in the inner surface of the mugs incubated with the contaminated milk. No measurable *B. cereus* count was found in the cups incubated with the control milk.

After both the short and the long wash cycle the mugs came out free from bacteria.

Example 4

Disinfecting activity of the Alkalinic Detergent Composition

The effect of the alkalinic detergent composition was tested by way of determining the resistance of a variety of bacteria and yeasts to said detergent. The tested microorganisms were:

Bacteria:

*Pseudomonas Aeruginosa*
*Streptococcus faecalis*
*Proteus vulgaris*
*Staphylococcus aureus*
*Streptococcus viridans*
Salmonella enteritidis G-C Yeasts:

*Candida albicans*

*Saccharomyces cerevisiae.*

Test Procedure

1. Microorganisms were suspended separately in a phosphate buffer saline, pH 7.2, to a level of about 1,000,000 units/40 microliter.
2. A pair of test tubes were prepared for each microorganism, one containing 4.5 ml buffer (for positive control) and the second with 4.5 ml. of the alkalinic detergent composition of Table I ("test solutions").
3. Aliquots of 40 microliter of each suspension were added to each pair of test tubes, and mixed well. 100 microliter were withdrawn from each test tube, 5 to 8 seconds after mixing and immediately poured into petri dishes with the adequate selective medium for each microorganism after which the plates were incubated.
4. The procedure set forth in clause 3 was repeated, but instead of withdrawal after 5–8 seconds, 100 microliters of mixture were withdrawn 30 seconds after mixing and then poured into petri dishes.
5. At the end of incubation each plate was examined for the presence of colonies.

Results

| | Contact time | | | |
|---|---|---|---|---|
| | 5–8 sec. | | 30 sec. | |
| | Test | Control | Test | Control |
| *Pseudomonas aeruginosa* | −* | +** | − | + |
| *Staphylococcus aureus* | − | + | − | + |
| *Streptococcus faecalis* | − | + | − | + |
| *Streptococcus viridans* | − | + | − | + |
| *Proteus vulgaris* | − | + | − | + |
| *Salmonella enteritidis* | − | + | − | + |
| *Candida albicans* | − | + | − | + |
| *Saccharomyces cerevisiae* | − | + | − | + |

*Number of colonies less than 10 per ml.

**Number of colonies too numerous to count (TNT)

Independent on the contact time between the microorganisms and the tested solution, in all cases microorganism growth was observed only in the control test tube, while in all test cases, when the detergent solution was present no bacterial growth was observed.

Example 5

Disinfecting effect of the Detergent System (Total Bacterial Count)

Ceramic drinking cups were contaminated by a mouth of an individual. A sample, similarly as in Example 3, was taken from each cup prior to and following washing by a dishwasher, operating with a washing cycle as described in Example 3 (Fresh Cup™).

The bacterial growth was tested similarly as described in Example 4 after different treatments including:

1. long washing cycle at room temperature;
2. long washing cycle with warm water (55° C.);
3. long washing cycle with warm water with the addition of an anti-bacterial agent;
4. long washing cycle at room temperature with the addition of an anti-bacterial agent.

Results

In all tests, where there was a very massive growth of bacteria prior to washing, no growth of bacteria was observed after washing.

Example 6

Disinfecting effect of the Detergent System (Total Bacterial Count)

Coffee with milk was prepared in a plurality of cups and then after individuals were allowed to drink their content. The empty cups were maintained unwashed for 48 hours. After 48 hours a bacterial count was obtained, in a similar manner to that described in Examples 4 and 5, for each of the following four groups of cups:

1. control—untreated cups;
2. cups washed by the long washing cycle of the Fresh Cup™ dishwasher;
3. cups washed by the short washing cycle of the Fresh Cup™ dishwasher;
4. cups washed with a standard, already used, sponge intended for washing cups.

The bacterial count of the cups of each group was obtained immediately after washing, without allowing the cups first to dry.

Results

The bacterial count obtained in each of the above groups, had the following results:

Group 1—$10^4$–$10^6$ colonies/ml;

Groups 2 and 3—less than 10 colonies/ml;

Group 4—The bacterial count increased to more than $10^7$ colonies/ml.

The increase in the bacterial count after washing with a standard sponge (Group 4) is a result of the fact that such sponges, which during use absorb food and other organic substances, provide a rich bed for the growth of bacteria which then contaminate the cups. The comparison of Groups 2 and 3 with Group 1 proves the high disinfecting potency of the detergent system of the invention.

I claim:

1. A dishwashing method comprising:

(a) rinsing with water, (b) applying a first liquid detergent composition to the dishes, (c) rinsing with water, (d) applying a second liquid detergent composition to the dishes, and (e) rinsing with water;

one of said first or said second detergent compositions being an alkalinic detergent composition having pH above about 11 and the other of the detergent compositions being an acidic detergent composition having pH above about 4; the liquid detergent compositions being applied to the dishes without dilution or after being diluted with water such that once applied to the dishes the compositions impart an acidic or alkalinic pH, respectively, to the surfaces of the dishes.

2. A method according to claim 1, wherein the first liquid detergent composition is an alkalinic detergent composition and the second liquid detergent composition is an acidic detergent composition.

3. A method according to claim 1, wherein said alkalinic detergent composition has a pH above about 14 and said acidic detergent composition has a pH below about 2.

4. A method according to claim 1, wherein the alkalinic detergent composition has an alkali level within a range of about 50–260 mg KOH/gr, and the acidic detergent composition has a level of free acid within a range of about 20–100 mg KOH/gr.

5. A method according to claim 1, wherein said first liquid detergent compositions and said second liquid detergent compositions are applied directly onto the dishes without prior dilution with water.

6. A method according to claim 1, wherein the alkalinic detergent composition comprises the following ingredients, in % (w/w): about 0.5–5% of a complexing agent; about 5–20% of an inorganic alkali; about 1–10% of an organic cosolvent; about 2–14% of an amphoteric surfactant; about 0.01–2% of an antibacterial agent; and demineralized water to complete to 100%.

7. A method according to claim 6, wherein the acidic detergent composition comprises the following ingredients in % (w/w): about 2–15% of an organic acid; about 1–10% of an organic cosolvent; about 1–10% alcohol; about 0.5–5% of an acidic surfactant; and demineralized water to complete to 100%.

8. A detergent system for use in a dishwashing method according to claim 1 comprising two liquid detergent compositions, one being an alkaline detergent composition having pH above about 11, and the other being an acidic detergent composition having pH below about 4, one of the compositions being applied in Step (b) of the method and the other being applied in Step (d) of the method.

9. A detergent system according to claim 8, wherein the alkalinic detergent composition comprises the following ingredients, in % (w/w): about 0.5–5% of a completing agent; about 5–20% of an inorganic alkali; about 1–10% of an organic cosolvent; about 2–14% of an amphoteric surfactant; about 0.01–2% of an antibacterial agent; and demineralized water to complete to 100%; and the acidic detergent composition comprises the following ingredients in % (w/w): about 2–15% of an organic acid; about 1–10% of an organic cosolvent; about 1–10% alcohol; about 0.5–5% of an acidic surfactant; and demineralized water to complete to 100%.

10. A method according to claim 1, wherein the acidic detergent composition comprises the following ingredients in % (w/w): about 2–15% of an organic acid; about 1–10% of an organic cosolvent; about 1–10% alcohol; about 0.5–5% of an acidic surfactant; and demineralized water to complete to 100%.

11. A detergent system for use in dishwashing, comprising two liquid detergents, each being applied in a different step of the dishwashing sequence, one of which being an alkalinic detergent composition having pH above about 11 and the other being an acidic detergent composition having pH below about 4.

12. A detergent system according to claim 11, wherein the alkalinic detergent composition comprises, in % (w/w): about 0.5–5% of a complexing agent; about 5–20% of an inorganic alkali; about 1–10% of an organic cosolvent; about 2–14% of an amphoteric surfactant; about 0.01–2% of an antibacterial agent; and demineralized water to complete to 100%; and wherein the acidic detergent composition comprises, in % (w/w): about 2–15% of an organic acid; about 1–10% of an organic cosolvent; about 1–10% alcohol; about 0.5–5% of an acidic surfactant; and demineralized water to complete to 100%.

* * * * *

UNITED STATES PATENT AND TRADEMARK OFFICE

CERTIFICATE OF CORRECTION

PATENT NO. : 5,879,469

DATED : 03/09/99

INVENTOR(S) : AVRAM

It is certified that error appears in the above-identified patent and that said Letters Patent is hereby corrected as shown below:

Claim 1, line 13, change "above" to -- below --.

Claim 9, lines 3 - 4, change "completing" to -- complexing --.

Signed and Sealed this

Fifth Day of October, 1999

*Attest:*

*Attesting Officer*

Q. TODD DICKINSON

*Acting Commissioner of Patents and Trademarks*